US008245954B2

(12) United States Patent
Tanaka et al.

(10) Patent No.: US 8,245,954 B2
(45) Date of Patent: Aug. 21, 2012

(54) SHOWERHEAD

(75) Inventors: Kazuhiro Tanaka, Yamagata (JP); Haruhiko Yasue, Nagoya (JP)

(73) Assignee: Tanaka Metal Industry Co., Ltd., Gifu (JP)

( * ) Notice: Subject to any disclaimer, the term of this patent is extended or adjusted under 35 U.S.C. 154(b) by 365 days.

(21) Appl. No.: 12/722,525

(22) Filed: Mar. 12, 2010

(65) Prior Publication Data

US 2010/0258653 A1 Oct. 14, 2010

(30) Foreign Application Priority Data

Apr. 14, 2009 (JP) ..... 2009-097809

(51) Int. Cl.
*E03C 1/08* (2006.01)

(52) U.S. Cl. ..... 239/428.5; 239/530; 239/525

(58) Field of Classification Search ..... 239/428.5, 239/530, 525, 434.4
See application file for complete search history.

(56) References Cited

U.S. PATENT DOCUMENTS 4,573,639 A * 3/1986 Logue ..... 239/428.5
5,826,799 A * 10/1998 Hsieh ..... 239/428.5

FOREIGN PATENT DOCUMENTS

WO WO 98/02250 * 1/1998

* cited by examiner

*Primary Examiner* — Dinh Q Nguyen
(74) *Attorney, Agent, or Firm* — Hiroe & Associates; Dwayne L. Bentley

(57) ABSTRACT

The purpose of the present device is to provide a simply-configured showerhead at a low price wherein the shower water is stopped simultaneously with the operation of the stop cock of the shower. Thus, sparing the user an unnecessary action of reattempting to turn off the stop cock. The showerhead comprises at least a body having a large channel and small channel defining a step and being in communication with each other. Further, nozzle is provided at one end of the showerhead and a water supply connection is provided at the other end. A partition tube may be inserted in the large channel to form an air-inflow chamber between the partition tube and the body. Thus, air may be introduced from an outer air-suction port into the water-inflow chamber through an inner air-suction port.

1 Claim, 8 Drawing Sheets

SHOWERHEAD

TECHNICAL FIELD

The present invention relates to a showerhead used in a shower room, and more particularly to a showerhead operable to mix air into shower water.

Various types of showerheads used in bathrooms and shower rooms have been developed. Among them, there is a showerhead operable to mix air into shower water, which provides continuous interruptions of the shower water to give good stimulation to a user's body as well as providing a water-saving effect, as shown in Japanese Patent Unexamined Application Publication No. 2002-119435 (see the abstract, selected drawing, paragraph 0009) (herein after referred to as "Reference 1").

Problem to be Solved

The invention disclosed in Reference 1 provides "a foam shower device enabling air to surely mix with shower water through an air ejector even at a low water pressure", and "in this foam shower device having the air ejector for mixing air into shower water, an air-suction part of the ejector is provided with an air supply means for auxiliary air supplying" as shown in FIG. 9. Thereby "a satisfactory air-mixing rate can be realized even under the condition of low water pressure so as to improve installation limitations on water pressure."

However, in the foam shower device in Reference 1, "Water is supplied through a water pipe to a narrowed nozzle 8 placed on the water way in a showerhead. Air is sucked trough an air hole 6 to mix with water, and the mixed water spouts through a spray board 7" (paragraph [0009] of Reference 1) as shown in FIG. 9, and such a configuration leads to the following issue.

In the "foam shower device" of Reference 1, "the air hole 6 is provided in the surrounding wall of the outlet port of the nozzle 8 to such air", and the air hole 6 is "provided near the outlet port of the narrowed nozzle 8". In other words, the "spraying plate 7" is located in the upper part in FIG. 9, and the "air hole 6" is located in the lower part in FIG. 9, and regardless of whether the device is being used or the device is hung on the wall, the "air hole 6" is always positioned in the lower part.

Therefore, according to the "foam shower device", because the "air hole 6" is located in the lower part, when the user stops the spout of the shower, water remaining in the shower head 1 leaks out through the "air hole 6". This means that water leaks out even though the user has turned off the shower, and the user would wonder whether the valve is securely turned off and may try to turn it off again until the water stops leaking out, which is in fact quite irrational.

Furthermore, in this type of showerhead, recently users occasionally change the showerheads for the color and/or shape that they like, which enriches their every day life, rather than using the original showerhead for a long time. For this reason, this type of showerhead needs to be provided at a low price.

The inventor of the present invention has been considering how this type of showerhead can be provided at a low price, and how the shower water is instantly stopped. As a result, the inventor now has completed the present invention.

Therefore, the purpose of the present invention is to provide a simply-configured showerhead at a low price, wherein the shower water is stopped simultaneously with the operation of the stop cock of the shower, sparing the user of the unnecessary action of reattempting to turn off the stop cock.

Solution to the Problem

In order to solve the above discussed problem, the present invention provides

"a showerhead 10 comprising: a body 11 having a large channel 11*a* and small channel 11*b* defined by a step 11*d* that communicates with each other; and a nozzle 12 for spewing water supplied through a hose 20 connected to the large channel 11*a*, wherein: a partition tube 13 having a water-inflow chamber 13*a* therein is inserted in the large channel 11*a* to form an air-inflow chamber 14 between the partition tube 13 and the body 11, and air is introduced from an outer air-suction port 11*c* into the water-inflow chamber 13*a* through an inner air-suction port 13*c*; and a joint 13*d* of the partition tube 13 is fixed by a fixing member 16 inserted in a fixing-member-receiving hole 11*e* formed in the body 11."

In other words, the showerhead 10 according to the invention has an appearance as illustrated in FIGS. 1-6, wherein the hose 20 for supplying water from a water heater or a mixing faucet (not shown) is connected to the lower end of the body 11, shower water is spewed though the nozzle 12 located in the upper part of the body 11, and the user can receive the shower water with air mixed in.

Particularly, as shown in FIGS. 2 and 4, the body 11 of the showerhead 10 has the large channel 11*a* and the small channel 11*b* defined by the step 11*d* and communicated with each other. The large channel 11*a* has a partition tube 13 inserted therein. The partition tube 13 has the water-inflow chamber 13*a* therein. As shown in FIGS. 1-4, the body 11 of the showerhead 10 has the outer air-suction port 11*c* formed in the front and back of the intermediate part thereof.

As shown in FIG. 2, the partition tube 13 has the water-inflow chamber 13*a* and a decompression chamber 13*b* that mutually communicates with each other, and a joint 13*d* at the bottom thereof, all of which are integrally formed therein. The partition tube 13 has an inner air-suction port 13*c* located in proximity to the joint 13*d* for allowing the outside and the decompression chamber 13*b* to communicate with each other. The upper end of the partition tube 13 in FIG. 2 has an outer diameter capable of abutting against the step 11*d* of the body 11.

The joint 13*d* formed at the bottom of the partition tube 13 has an orifice-receiving hole 13*e* therein for receiving an orifice member 15 (described later) as shown in FIG. 2. The joint 13*d* has an annular groove 13*f* formed along the outer periphery thereof for engaging a fixing member 16 (described later). The joint 13*d* has a joint screw 13*g* formed along the outer periphery thereof, with which the above-described hose 20 is attached.

The partition tube 13 is inserted in the large channel 11*a* of the body 11, forming an air-inflow chamber 14 between the tube 13 and the body 11, and thereby air from the outer air-suction port 11*c* formed in the body 11 is introduced to the water-inflow chamber 13*a* through the inner air-suction port 13*c* formed in the partition tube 13.

The partition tube 13 is easily secured to the body 11 by inserting the fixing member 16 through the fixing-member-receiving hole 11*e* formed in the body 11, and engaging the member 16 with the annular groove 13*f* formed along the outer periphery of the joint 13*d*.

In other words, the showerhead 10 according to the invention is easily made by attaching the nozzle 12 to the upper end of the body 11 with a screw 12*b*, inserting the partition tube 13 into the large channel 11*a*, securing the partition tube 13 to the body 11 with the fixing member 16 inserted from the outside of the body 11. By attaching an orifice member 15 having a water-passing hole of a user's preferential size into the orifice-receiving hole 13*e* of the partition tube 13, the showerhead 10 in accordance with the user's preference is then completed.

As a result of the above, first of all, the showerhead 10 according to the present invention may be manufactured and provided in accordance with the user's preference at a low cost.

In addition, in the showerhead 10, as shown in FIG. 2, the partition tube 13 having the water-inflow chamber 13*a* therein is provided in the body 11, and thereby the air-inflow chamber 14 is formed between the tube 13 and the body 11.

Furthermore, in the showerhead 10, as shown in FIG. 2, the orifice member 15 is mounted in the lower end of the partition tube 13, and the decompression chamber 13*b* is formed in the slipstream of the orifice member 15, and the inner air-suction port 13*c* is formed in the partition tube 13, which surrounds the decompression chamber 13*b*. In addition, the outer air-suction port 11*c* is formed in the body 11 at a place corresponding to the upper portion of the partition tube 13.

In the showerhead 10 of the present invention configured as above, when a user opens a cock such as a mixing faucet (not shown) to use the showerhead 10, water is provided through the hose 20 and passes through the orifice member 15. At this time, a decompression state is formed in the decompression chamber 13*b*, and thereby air or remaining water in the air-inflow chamber 14 flows into the water-inflow chamber 13*a* of the partition tube 13 through the inner air-suction port 13*c* opening into the decompression chamber 13*b*. Naturally, the suction of the air or remaining water in the air-inflow chamber 14 will result in the suction of air from the outside through the outer air-suction port 11*c*.

Right after the user opens a cock, "water" is flown into the water-inflow chamber 13*a* of the partition tube 13 through the inner air-suction port 13*c*, this is because the water was remaining in the showerhead 10 when it was previously used, and once the remaining water is completely suctioned, air from the outside is then suctioned into the water supplied through the hose 20, and becomes foam.

As a result of the above, when the showerhead 10 is in use, the combination of water and air spouts from each nozzle 12*a* of the nozzle 12 included in the showerhead 10 as shower water containing bubbles, which gives the user's body a good stimulation. This is because when the user takes a shower using the showerhead 10, the water hits the user's body intermittently, and not continuously. Furthermore, it saves an amount of water for the air interrupting the shower water, and this showerhead gives the effect of killing two birds with one stone.

When the user stops taking shower with the showerhead 10, the water stops spouting from the nozzle 12, and the remaining water within the showerhead 10 above the outer air-suction port 11*c* falls into the water-inflow chamber 13*a* under its own weight, and then flows into the air-inflow chamber 14 through the inner air-suction port 13*c* opening to the water-inflow chamber 13*a*. This is because while the showerhead 10 is being used, only air exists in the air-inflow chamber 14 and no remaining water exists in it. Therefore, once the user stops using the showerhead 10, the water falling through the water-inflow chamber 13*a* flows into the air-inflow chamber 14 with the air pushed out through the outer air-suction port 11*c*.

In other words, when the user stops the use of the showerhead 10, the remaining water within the showerhead 10 is accumulated within the water-inflow chamber 13*a* and air-inflow chamber 14, and therefore does not flow out of the showerhead 10, as in the conventional technique as shown in FIG. 9.

Therefore, according to the showerhead 10, secondly, when the user stops supplying water into the showerhead 10, the remaining water does not leak out of the showerhead 10, and it is not necessary to turn off the mixing faucet again.

In the showerhead 10, the volume of the air-inflow chamber 14 is formed to be larger than the inner volume of the body 11 above the outer air-suction port 11*c*. In this configuration of the showerhead 10, the water remaining inside when the shower is stopped, is fully accumulated within the showerhead 10. In other words, in the showerhead 10, when the water remaining in the body 11 above the outer air-suction port 11*c* falls down due to the loss of the pressure from the hose 20, all the remaining water is returned into the air-inflow chamber 14.

Thus, along with the functions as the above, thirdly, the showerhead 10 is able to securely hold the remaining water therein when the shower is stopped.

Advantageous Effects

As explained above, the present invention features:

"a showerhead 10 comprising: a body 11 having a large channel 11*a* and small channel 11*b* defined by a step 11*d* mutually communicates with each other; and a nozzle 12 for spouting water supplied through a hose 20 connected to the large channel 11*a*, wherein: a partition tube 13 having a water-inflow chamber 13*a* therein is inserted in the large channel 11*a* to form an air-inflow chamber 14 between the partition tube 13 and the body 11, and air is introduced from an outer air-suction port 11*c* into the water-inflow chamber 13*a* through an inner air-suction port 13*c*; and a joint 13*d* of the partition tube 13 is fixed by a fixing member 16 inserted in a fixing-member-receiving hole 11*e* formed in the body 11", and thereby the shower water is stopped simultaneously with the operation of the stop cock of the shower, sparing the user an unnecessary action of reattempting to turn off the stop cock, and the showerhead 10 is provided in a simple configuration at a low cost.

BEST MODE

Figure 1:
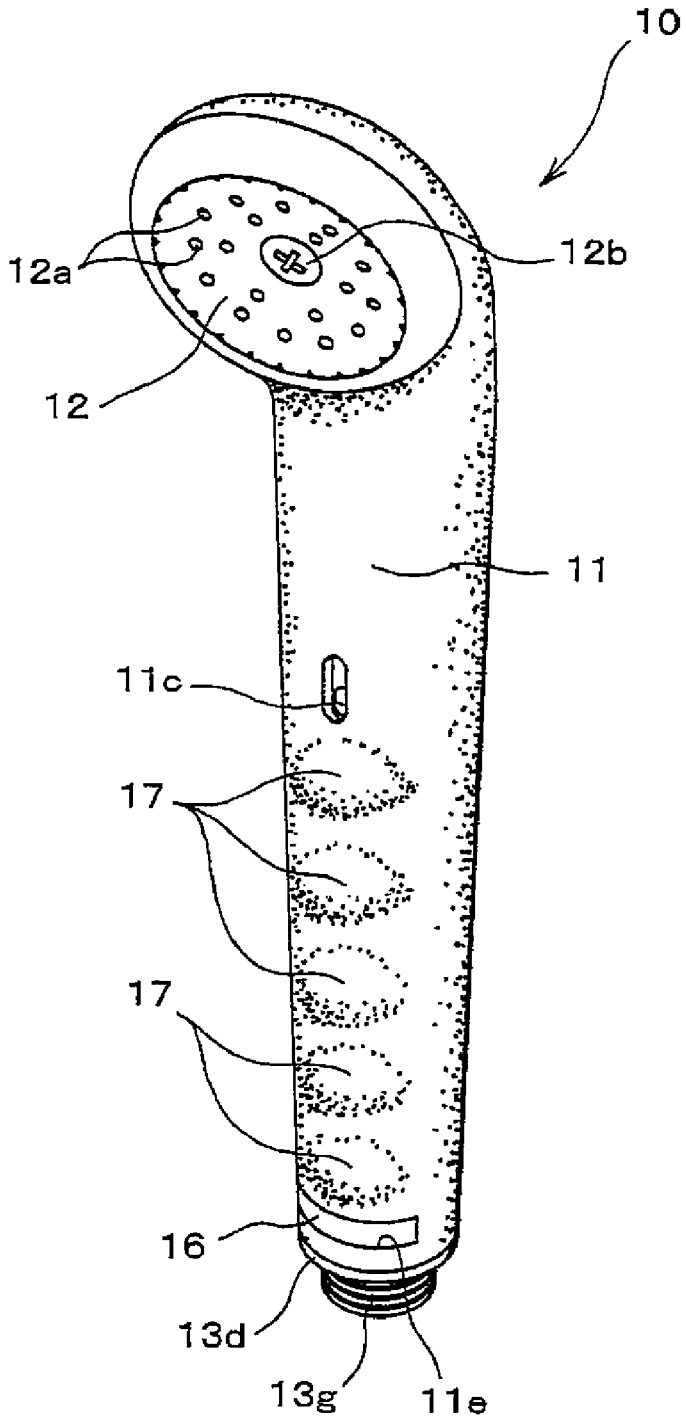
FIG. 1 is a perspective view of a showerhead according to the present invention.
Figure 2:
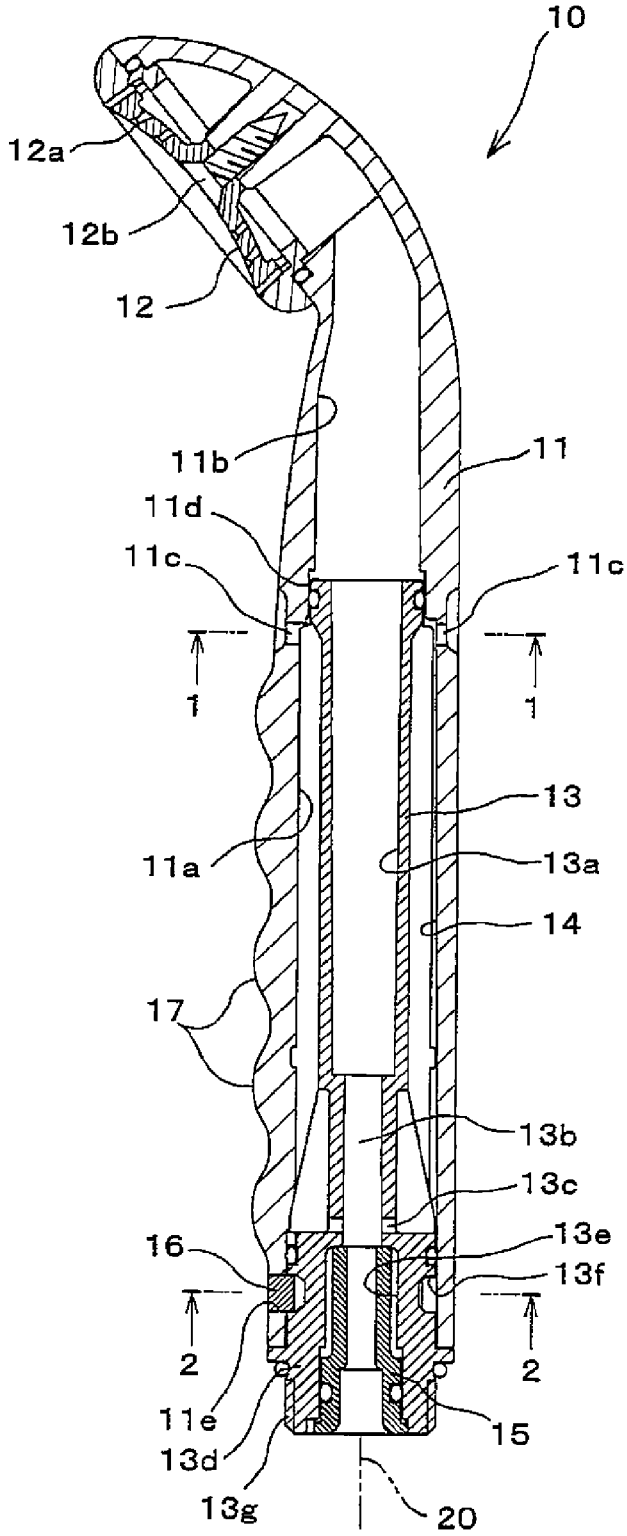
FIG. 2 is a longitudinal sectional view of the showerhead of FIG. 1.
Figure 3A:
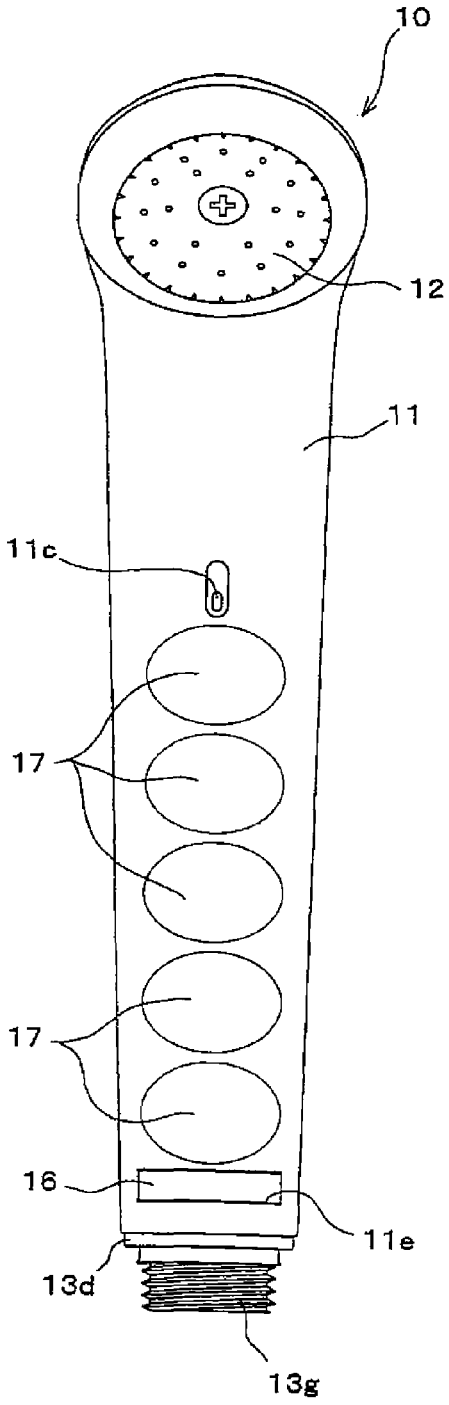
FIG. 3A is a front view of the showerhead of FIG. 1.
Figure 3B:
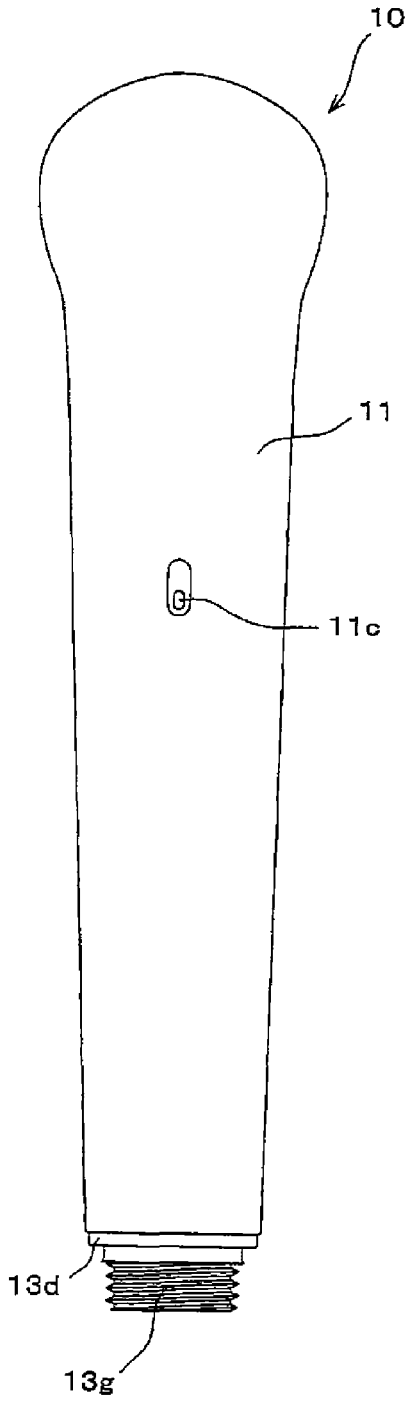
FIG. 3B is a back view of the showerhead of FIG. 1.

The present invention configured as above is now explained referring to the drawings, FIG. 1 shows a perspective view of the showerhead 10 according to the present invention. While the showerhead 10 does not have much difference from the conventional technique in the appearance as shown in FIG. 1, the body 11 of the showerhead 10 has the outer air-suction port 11*c* opening to the outside at preferably a little above a place where grappled by a user's hand. The showerhead 10 is, of course, connected to a water source such as a mixing faucet or water heater (not shown) via a hose 20 at the lower end thereof, through which water is supplied. The water is spewed from nozzle holes 12*a* of a nozzle 12 provided in the upper part of the body 11 of FIG. 1. The nozzle 12 is attached to the body 11 by means of a screw 12*b* as shown in FIG. 2. However, it should be appreciated that nozzle 12 may be attached by a variety of other conventional or non conventional methods such as, but not limited to, various threaded connections, male-female connections, integrally formed, and the like.

Figure 4:
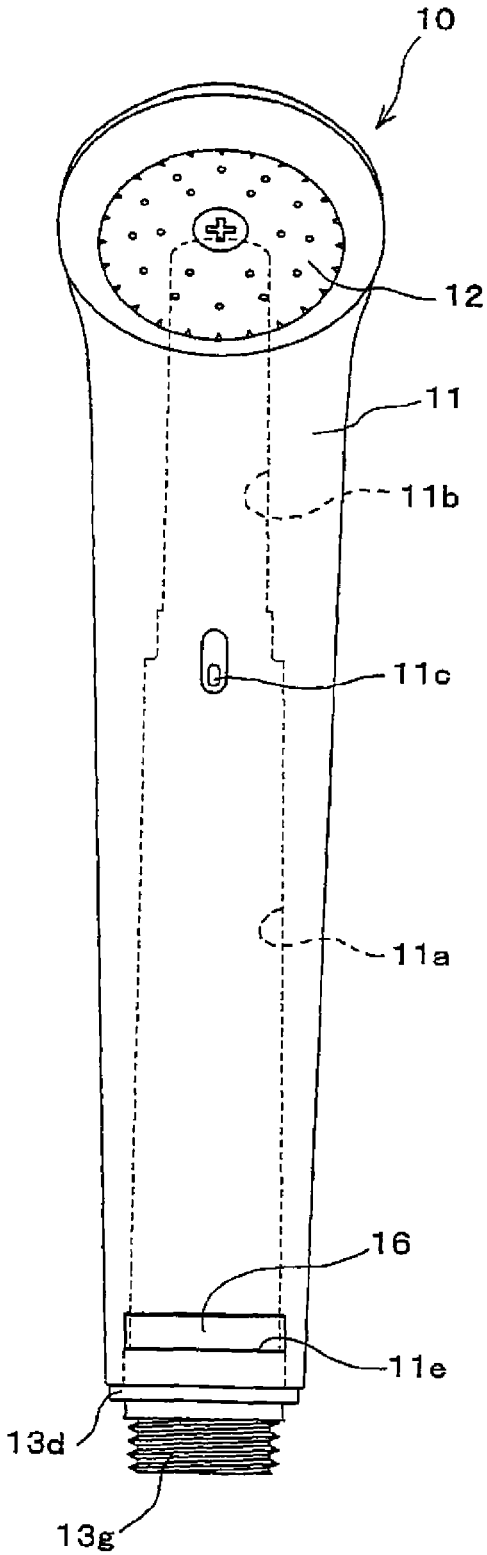
FIG. 4 is a front view of the showerhead of FIG. 1 showing the positional relationship between a large channel and a small channel.
Figure 5A:
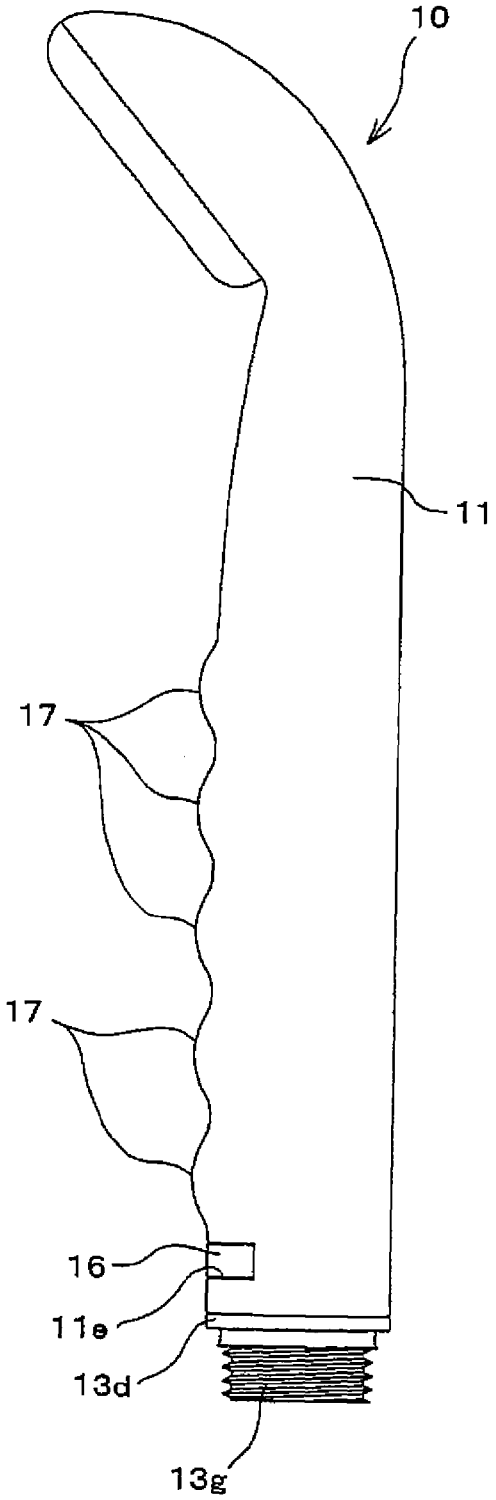
FIG. 5A is a right side view of the showerhead of FIG. 1 in its appearance.
Figure 5B:
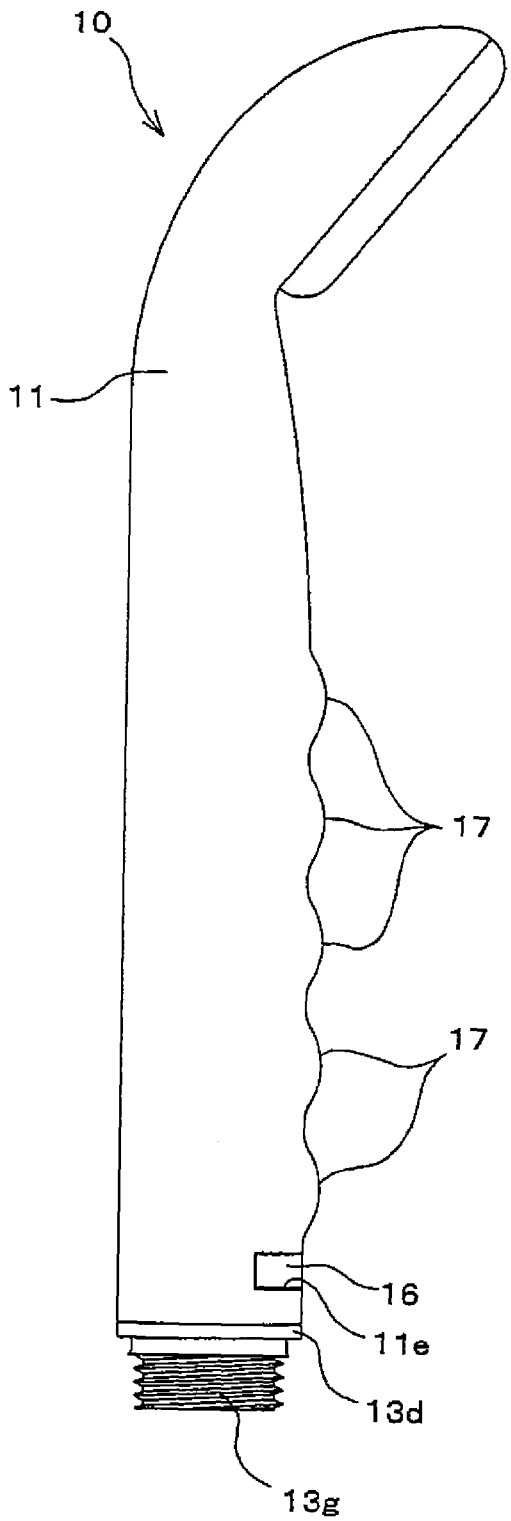
FIG. 5B is a left side view of the showerhead of FIG. 1 in its appearance.
Figure 6A:
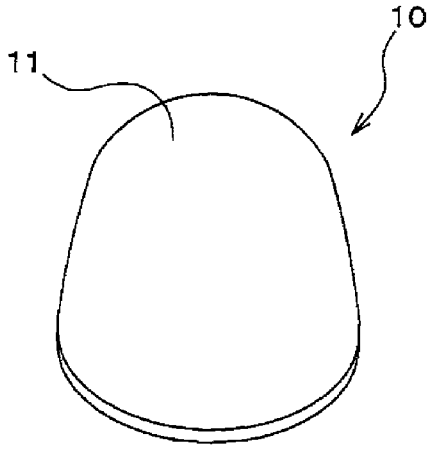
FIG. 6A is a plan view of the showerhead of FIG. 1 in its appearance.
Figure 6B:
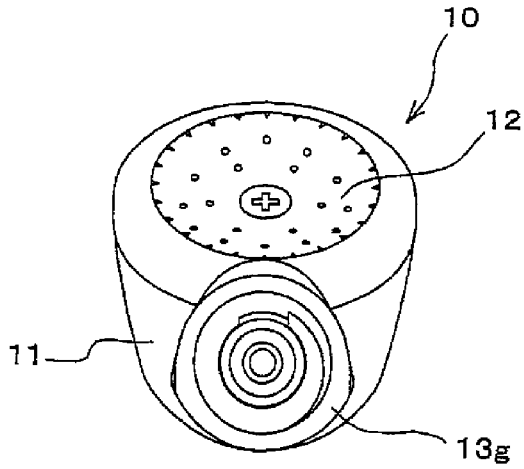
FIG. 6B is a bottom view of the showerhead of FIG. 1 in its appearance.
Figure 7A:
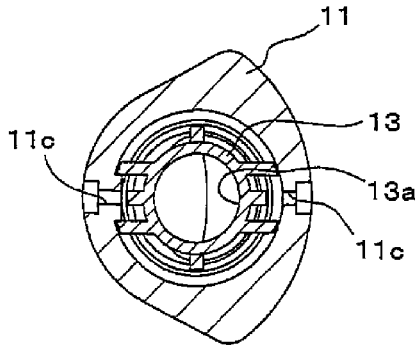
FIG. 7A is a cross-sectional view of the showerhead along the line 1-1 of FIG. 2.
Figure 7B:
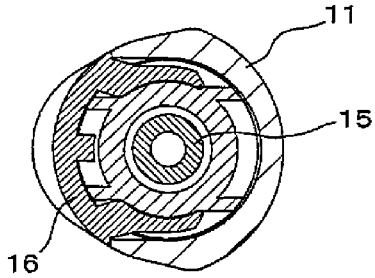
FIG. 7B is a cross-sectional view of the showerhead along the line 2-2 of FIG. 2.
Figure 7C:
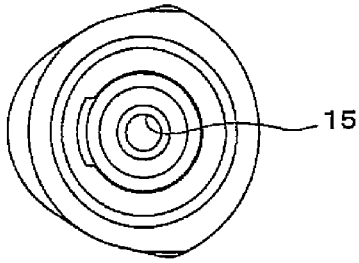
FIG. 7C is a bottom view of the showerhead of FIG. 2.

Particularly, as shown in FIGS. 2 and 4, the body 11 of the showerhead 10 has the large channel 11*a* and the small channel 11*b* defined by the step 11*d* mutually communicating with each other. The large channel 11*a* has a partition tube 13 inserted therein. The partition tube 13 has the water-inflow chamber 13*a* therein. As shown in FIGS. 1-4, the body 11 of the showerhead 10 has the outer air-suction port 11*c* formed in the front and back of the intermediate part thereof.

As shown in FIG. 2, the partition tube 13 has the water-inflow chamber 13*a* and a decompression chamber 13*b* mutually communicating with each other, and a joint 13*d* at the bottom thereof, all of which are preferably integrally formed therein. However, it should be appreciated that said sections may also be individually manufactured and be assembled utilizing a variety of conventional and non conventional connection methods. The partition tube 13 has a inner air-suction port 13*c* located in proximity to the joint 13*d* for allowing the outside and the decompression chamber 13*b* to be communicated with each other. The upper end of the partition tube 13 in FIG. 2 preferably has an outer diameter capable of abutting against the step 11*d* of the body 11.

The inside of the joint 13*d* formed at the bottom of the partition tube 13 has an orifice-receiving hole 13*e* therein for receiving an orifice member 15 (described later) as shown in FIG. 2. The joint 13*d* has an annular groove 13*f* formed along the outer periphery thereof for engaging a fixing member 16 (described later). The joint 13*d* has a joint screw 13*g* formed along the outer periphery thereof, with which the above-described hose 20 is attached. However, it should be appreciated that the connection between the hose 20 and the showerhead 10 should not be viewed as a limitation herein as there are a variety of coupling methods between showerheads and water supplies.

The partition tube 13 is inserted in the large channel 11*a* of the body 11, forming an air-inflow chamber 14 between the tube 13 and the body 11, and thereby air from the outer air-suction port 11*c* formed in the body 11 is introduced to the water-inflow chamber 13*a* through the inner air-suction port 13*c* formed in the partition tube 13.

The partition tube 13 is easily secured to the body 11 by inserting the fixing member 16 through the fixing-member-receiving hole 11*e* formed in the body 11, and engaging the member 16 with the annular groove 13*f* formed along the outer periphery of the joint 13*d*.

In other words, the showerhead 10 according to the invention is easily made by attaching the nozzle 12 to the upper end of the body 11 preferably with, but not limited to, a screw 12*b*, inserting the partition tube 13 into the large channel 11*a*, securing the partition tube 13 to the body 11 with the fixing member 16 inserted from the outside of the body 11. By attaching an orifice member 15 having a water-passing hole of a user's preferred size into the orifice-receiving hole 13*e* of the partition tube 13, the showerhead 10 in accordance with the user's preference is then completed.

As shown in FIG. 2, the body 11 has the partition tube 13 therein, which has the water-inflow chamber 13*a* therein. The water-inflow chamber 13*a* is communicated with the hose 20 at the lower end thereof, and the nozzle holes 12*a* of the nozzle 12 at the upper end thereof.

The space between the outer surface of the partition tube 13 and the inner surface of the body 11 serves as an air-inflow chamber 14. The volume of the air-inflow chamber is formed bigger than the inner volume of the body 11 above the outer air-suction port 11*c*. In other words, the air-inflow chamber 14 is able to store all the water remaining above the outer air-inflow port 11*c*.

The orifice member 15 is placed between the partition tube 13 and the hose 20 as shown in FIG. 2. The orifice member 15 has a cross-sectional shape where the water channel of the orifice member 15 is narrowed down, and thereby at the narrowed part the water channel hastens the flow speed of water from the hose 20. When the orifice member 15 releases the water into the lower part of the partition tube 13 (namely the decompression chamber 13*b*), which is located above the orifice member 15 in FIG. 2, the orifice member 15 causes a decompression effect in the decompression chamber 13*b*.

Figure 8:
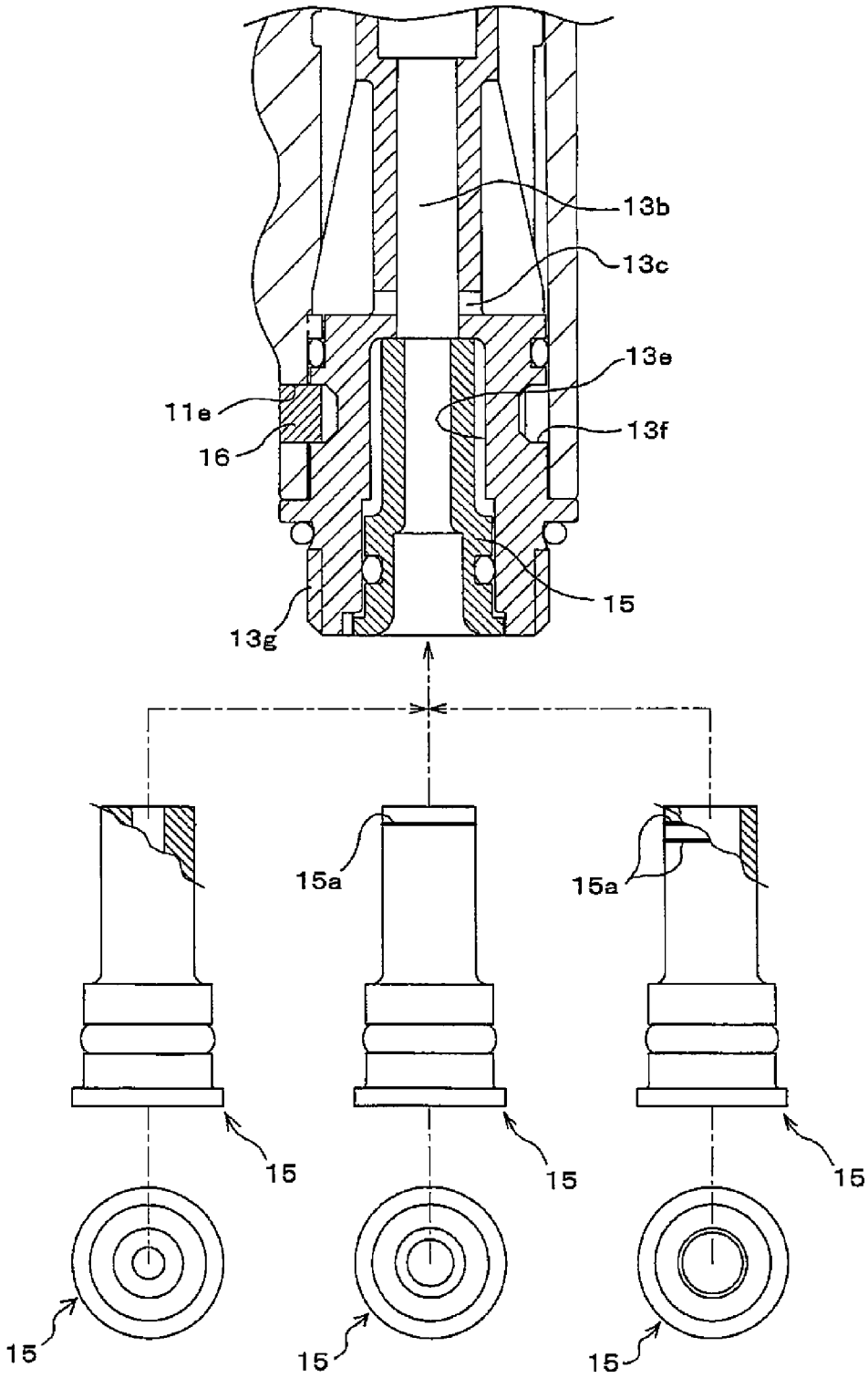
FIG. 8 is enlarged front views and bottom views of office members showing how each office member is inserted into an orifice-receiving hole.
Figure 9:
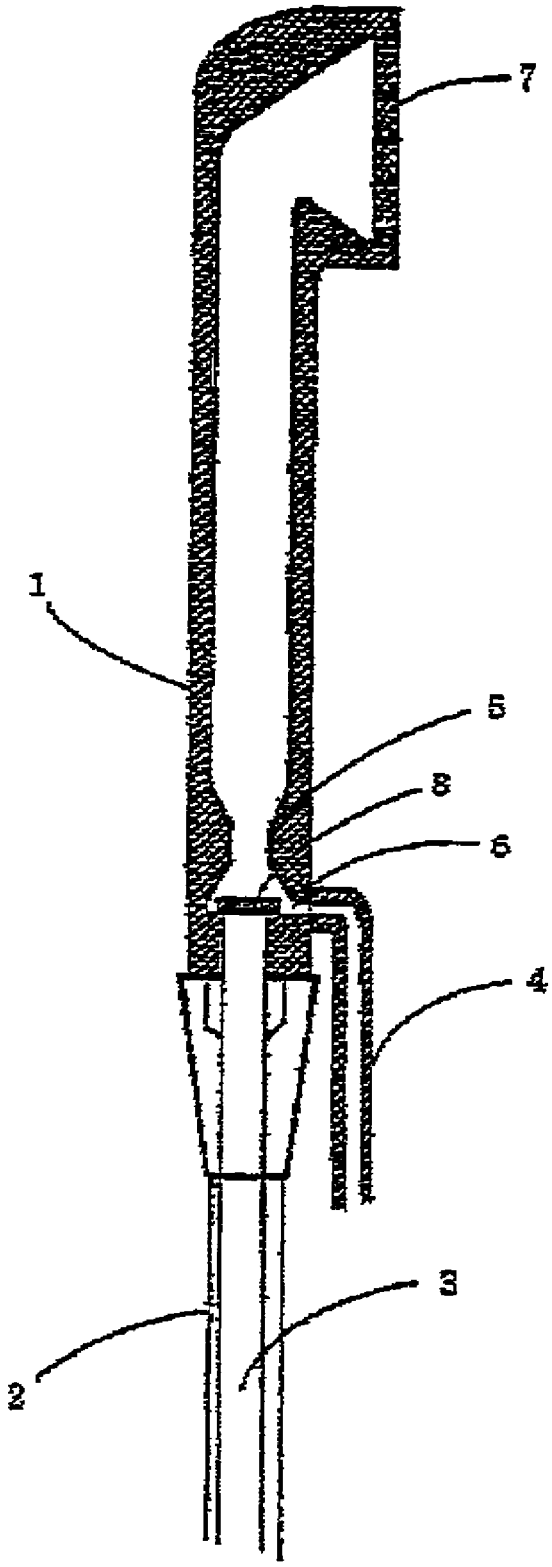
FIG. 9 is a longitudinal sectional view showing a conventional technique.

As shown in FIG. 8, the orifice member 15 may be prepared in three types for the same showerhead 10. These three types of the orifice members 15 differ from each other in the size of the water channel therein, and have a small, medium, and large water channel respectively. They may be easily recognized with the mark 15*a* on the surface. In the present embodiment, the orifice without the mark 15*a* has the smallest inside diameter of the water channel, the one with the mark 15*a* of a line has the medium, and the one with the mark 15*a* of two lines has the large. Of course, these orifice members 15 have a common outer diameter so that any of them may be inserted in the orifice-receiving hole 13*e* of the partition tube 13. It should be understood that the selection of only three (3) types of orifice members 15, as illustrated in FIG. 8, should not be viewed as a limitation herein. It is envisioned that a variety of water channel sizes and diameters may be manufactured. Further, the use of markings 15*a* is purely for illustrative purposes as any number of size identifiers may be chosen to specify a particular water channel size/diameter.

The difference in the size of the water channel formed in each orifice member 15 changes the level of negative pressure generated in the slipstream when water is supplied through the hose 20 in the same pressure. Because smaller the water channel is, smaller the negative pressure of the slipstream, the amount of air sucked through the outer air-suction port 11*c* or inner air-suction port 13*c* may be increased. When the water channel is large, the amount of water may be increased compared with the small one.

The inner air-suction port 13*c* is formed in the circumference of the decompression chamber 13*b* of the partition tube 13, and communicated with the outer air-suction port 11*c* of the body 11 via the air-inflow chamber 14. In other words, when water flows into the showerhead 10, a decompression state is formed in the decompression chamber 13*b*, which then causes the suction of outside air from the outer air-suction port 11*c* into the water-inflow chamber 13*a* through the air-inflow chamber 14.

The showerhead 10 of the preferred embodiment preferably has slip stoppers 17 formed on the body 11 where gripped by the user as shown in FIGS. 1 and 2, and with the slip stoppers 17 the user may grab the body 11 without any slip.

Obviously, other modifications and variations of the disclosed device are possible in the light of the above teachings. It is therefore to be understood that changes may be made in the particular embodiments described above which are within the full intended scope as defined in the appended claims.

While the present system and method has been disclosed according to the preferred embodiment, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the system or methods disclosed herein to those particular embodiment configurations. These terms may reference the same or different embodiments, and are combinable into aggregate embodiments. The terms "a", "an" and "the" may also mean "one or more".

None of the description in this specification should be read as implying that any particular element, step or function is an essential element which must be included in the claim scope. The scope of the patented subject matter is defined by the allowed claims and their equivalents. Unless explicitly recited, other aspects of the instant disclosure as described in this specification do not limit the scope of the claims. Because many varying and different embodiments may be made within the scope of the novel concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A showerhead comprising:

a body having a large channel and small channel therein, wherein said large channel abuts to and is in communication with said small channel, and wherein said abutment defines a step; and a nozzle for discharging water supplied to the large channel, wherein a partition tube having a water-inflow chamber therein is inserted in the large channel to form an air-inflow chamber between the partition tube and the body, and wherein air is introduced from an outer air-suction port into the water-inflow chamber through an inner air-suction port, and wherein a joint of the partition tube is fixed by a fixing member inserted in a fixing-member-receiving hole formed in the body.

* * * * *